US009042760B2

(12) United States Patent
Mita

(10) Patent No.: US 9,042,760 B2
(45) Date of Patent: May 26, 2015

(54) HEATING DEVICE

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Katsutoshi Mita, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 66 days.

(21) Appl. No.: 13/852,299

(22) Filed: Mar. 28, 2013

(65) Prior Publication Data

US 2013/0272737 A1 Oct. 17, 2013

Related U.S. Application Data

(60) Provisional application No. 61/619,535, filed on Apr. 3, 2012.

(30) Foreign Application Priority Data

Feb. 28, 2013 (JP) ..... 2013-039323

(51) Int. Cl.
*G03G 15/20* (2006.01)
*G03G 21/00* (2006.01)

(52) U.S. Cl.
CPC ..... *G03G 15/2039* (2013.01); *G03G 15/205* (2013.01); *G03G 21/00* (2013.01)

(58) Field of Classification Search
USPC ..... 399/69, 44, 70
See application file for complete search history.

(56) References Cited

U.S. PATENT DOCUMENTS

| | | | | |
|---|---|---|---|---|
| 5,534,987 | A | 7/1996 | Ohtsuka et al. | |
| 7,885,571 | B2 * | 2/2011 | Omura | 399/69 X |
| 2010/0239300 | A1 * | 9/2010 | Sato | 399/69 |

(Continued)

FOREIGN PATENT DOCUMENTS

| | | |
|---|---|---|
| JP | 60-213977 | 10/1985 |
| JP | 06-242700 | 9/1994 |
| JP | 2001-242743 | 9/2001 |

(Continued)

OTHER PUBLICATIONS

Machine translation of Amita, JP 2003-323073 (published on Nov. 14, 2003), printed on Sep. 10, 2014.*

(Continued)

*Primary Examiner* — Sophia S Chen
(74) *Attorney, Agent, or Firm* — Amin, Turocy & Watson, LLP

(57) ABSTRACT

According to one embodiment, there is provided a heating device that includes a heating source, a non-contact thermistor, a contact thermistor and a control unit. The control unit is configured to control the heating source on the basis of the detected temperature of the non-contact thermistor and the detected temperature of the contact thermistor and control the heating member to a predetermined temperature. The control unit performs the temperature control using the detected temperature of the contact thermistor for temperature control from startup time to a target temperature and using the detected temperature of the non-contact thermistor if the temperature exceeds the target temperature.

4 Claims, 4 Drawing Sheets

(56) References Cited

U.S. PATENT DOCUMENTS

2011/0229180 A1* 9/2011 Saito ..... 399/69
2012/0051766 A1* 3/2012 Ueno et al. ..... 399/70 X

FOREIGN PATENT DOCUMENTS

JP 2003-323073 11/2003
JP 2006-276564 A * 10/2006
JP 2011-227329 11/2011

OTHER PUBLICATIONS

Japanese Office Action for Japanese Patent Application No. 2013-039323 mailed on Feb. 12, 2014.

* cited by examiner

| AREA NUMBER | VALUE OF a |
|---|---|
| AREA 1 | 0.3 |
| AREA 2 | 0.4 |
| AREA 3 | 0.5 |

HEATING DEVICE

CROSS-REFERENCE TO RELATED APPLICATION

This application is based upon and claims the benefit of priority from: U.S. provisional application 61/619,535 filed on Apr. 3, 2012; and JP application No. 2013-039323 filed on Feb. 28, 2013; the entire contents of each of which are incorporated herein by reference.

FIELD

Embodiments described herein relate generally to a temperature control technique for a heat roller in a heating device such as a fixing device that heats and pressurizes an unfixed toner image on a sheet to fix the unfixed toner image on the sheet.

BACKGROUND

An image forming apparatus of an electrophotographic system detects, in temperature control for a fixing device, the temperature of the outer circumferential surface of a heat roller in a non-contact manner using non-contact temperature detecting means and controls, with a control unit, the temperature to a predetermined fixing temperature.

It has been proposed to measure the surface temperature of the heat roller using an inexpensive non-contact thermistor instead of an expensive thermopile as the non-contact temperature detecting means (JP-A-2009-175538)

Compared with the thermopile, the non-contact thermistor causes deterioration in detection accuracy of temperature because of the influence of a gap between the non-contact thermistor and the heat roller surface, which is a measurement target, and ambient temperature. Therefore, in some cases, highly accurate temperature control cannot be performed. Further, it is likely that, depending on an attachment state of the non-contact thermistor, fluctuation occurs in the gap between the non-contact thermistor and the heat roller surface and the heat roller cannot be accurately controlled.

DETAILED DESCRIPTION

It is an object of the present invention to provide a heating apparatus that can highly accurately subject a heat roller to temperature control using a non-contact thermistor as a main thermistor.

In general, according to one embodiment, there is provided a heating device that heats a toner image on a sheet fed to a nip portion between a heating member and a pressurizing member.

The heating device includes: a heating source configured to heat the heating member; a non-contact thermistor arranged while having a gap between the non-contact thermistor and the heating member and configured to detect the temperature of the heating member; a contact thermistor configured to come into contact with the heating member and detect the temperature of the heating member; and a control unit configured to control the heating source on the basis of the detected temperature of the non-contact thermistor and the detected temperature of the contact thermistor and control the heating member to a predetermined temperature. The control unit performs the temperature control using the detected temperature of the contact thermistor for temperature control from startup of the heating of the heating sourcetime until an arrival of to a target temperature and using the detected temperature of the non-contact thermistor afterif the temperature exceeds the target temperature .g A heating device is explained below on the basis of an embodiment shown in the figures.

Figure 1:
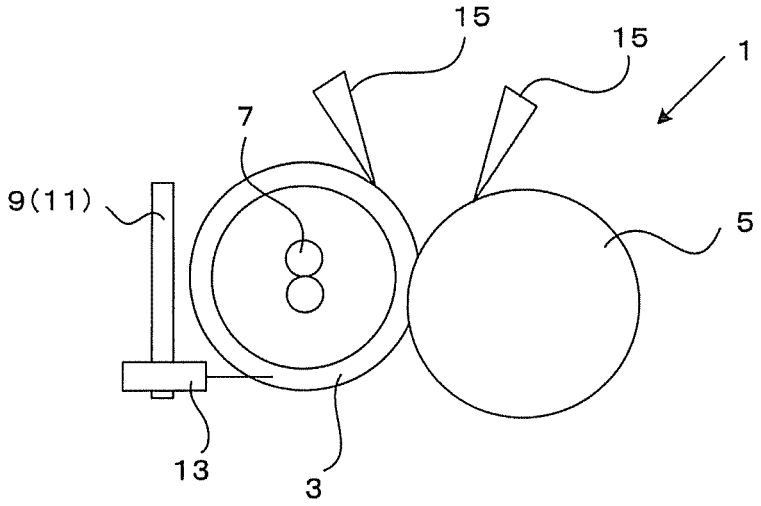
FIG. 1 is a diagram showing a schematic configuration of an embodiment in which a heating device is applied to a fixing device.
Figure 2:
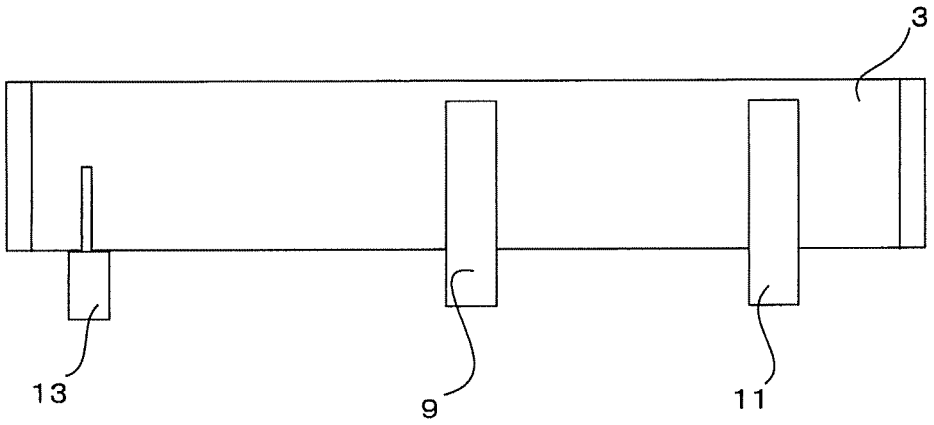
FIG. 2 is a diagram showing arrangement positions of non-contact thermistors and a contact thermistor with respect to a heat roller shown in FIG. 1.
Figure 3:
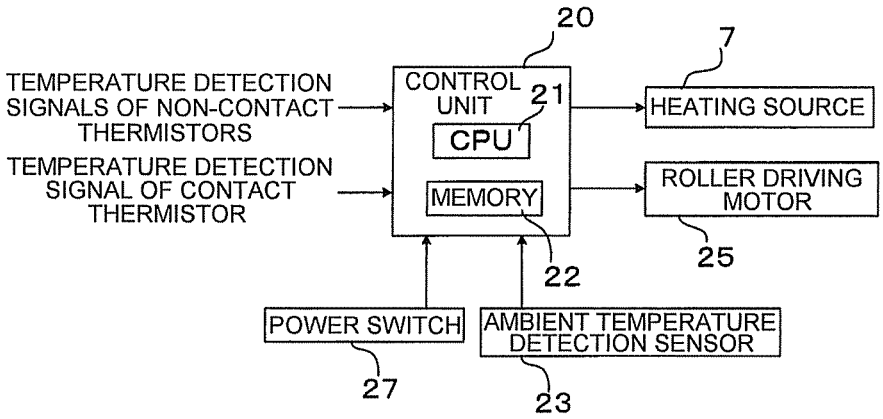
FIG. 3 is a circuit block diagram of a control unit.
Figure 4:
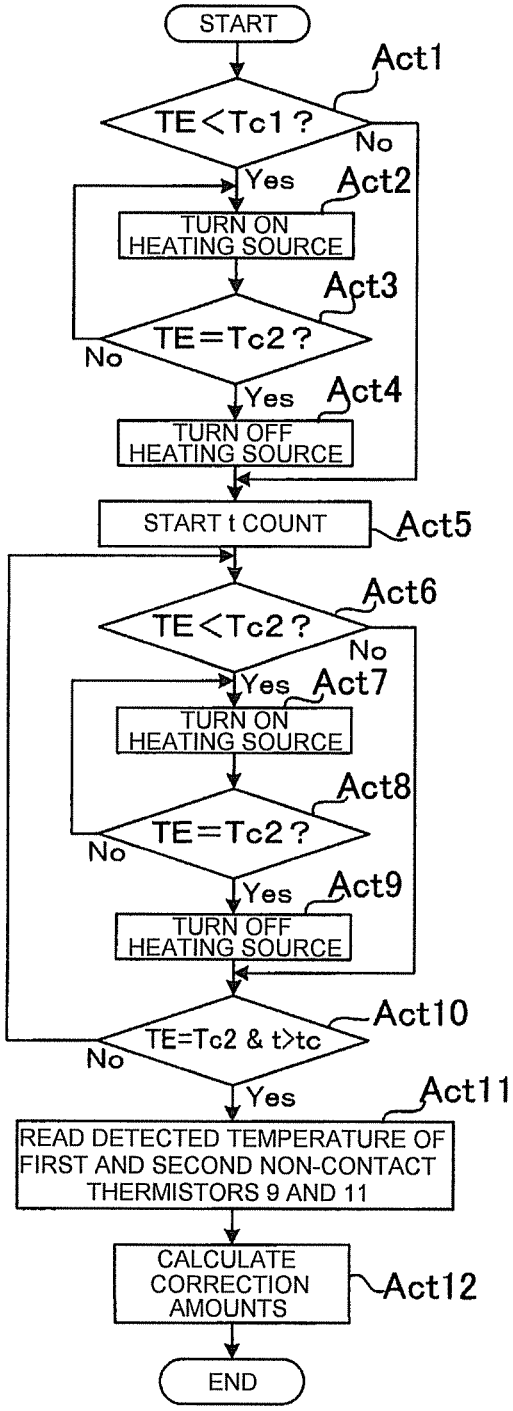
FIG. 4 is a flowchart for explaining a flow of correction processing by the control unit shown in FIG. 3.

FIG. 1 is a diagram showing a schematic configuration of an embodiment in which a heating device is applied to a fixing device. FIG. 2 is a diagram showing arrangement positions of non-contact thermistors and a contact thermistor with respect to a heat roller shown in FIG. 1. FIG. 3 is a circuit block diagram of a control unit. FIG. 4 is a flowchart for explaining a flow of correction processing by the control unit shown in FIG. 3.

In FIGS. 1 and 2, a fixing device 1 is arranged in a not-shown image forming apparatus main body. The fixing device 1 fixes an unfixed toner image on a sheet by heating and pressurizing the unfixed toner image. In the fixing device 1, a fixing roller (a heat roller) 3 functioning as a heating member and a pressurizing roller (a press roller) 5 functioning as a pressurizing member are brought into pressurized contact with each other by not-shown pressurizing means. The sheet having the unfixed toner image transferred thereon is fed to a nip portion where both the rollers are brought into pressurized contact with each other. The heat roller 3 is heated by energization to a heating source 7 such as a halogen lamp housed in a hollow section. The heat roller 3 and the press roller 5 are driven by a roller driving motor (not shown in the figure).

A first non-contact thermistor 9 and a second non-contact thermistor 11 are arranged to be opposed to the outer circumferential surface of the heat roller 3 while having a predetermined gap therebetween. The first non-contact thermistor 9 and the second non-contact thermistor 11 respectively detect the temperatures of the outer circumferential surface of the heat roller 3. The first non-contact thermistor 9 is arranged in the center in the length direction of the heat roller 3. The second non-contact thermistor 11 is arranged at one end in a largest sheet passing region. A contact thermistor 13 is brought into contact with the outer circumferential surface of the heat roller 3 to detect the temperature of the outer circumferential surface of the heat roller 3. The contact thermistor 13 is arranged at the other end in the length direction of the heat roller 3 on the opposite side of the arrangement position of the second non-contact thermistor 11 and is arranged further on the outer side than the other end of the largest sheet passing region.

The first non-contact thermistor 9 and the second non-contact thermistor 11 are arranged in a sheet passing region to prevent a contact scar due to the thermistors from being formed on the outer surface of the heat roller 3 and eliminate the influence on a fixed image due to the contact scar. A toner adhering to the outer circumferential surfaces of the heat roller 3 and the press roller 5 is peeled by peeling claws 15.

A control unit 20 shown in FIG. 3 includes a processing unit (a CPU) 21 configured to perform energization control for the heating source 7 and a memory 22. The memory 22 is, for example, a semiconductor memory. The memory 22 includes a ROM (Read Only Memory) having stored therein various control programs and a RAM (Random Access Memory) configured to provide the processing unit 21 with a temporary work area. In the ROM, a flowchart of processing of FIG. 4 explained below, a correction table for calculating correction amounts taking into account ambient temperature shown in Table 1, a coefficient calculation table for calculating coefficients "a" from a relation between correction amounts and correction-time ambient temperature shown in FIG. 5, and a thermistor switching table shown in Table 2 are stored.

Temperature detection signals respectively detected by the first non-contact thermistor 9, the second non-contact thermistor 11, and the contact thermistor 13 are output to the control unit 20. An ambient temperature detection signal detected by an ambient temperature detection sensor 23 provided in the image forming apparatus main body is output to the control unit 20. A power-on signal (a startup signal) from a power switch 27 is output to the control unit 20.

Further, the control unit 20 performs driving control for the heating source 7 and the roller driving motor 25.

In this embodiment, the first non-contact thermistor 9 and the second non-contact thermistor 11 are used as main thermistors. The contact thermistor 13 is used for correction of the main thermistors and used as a sub-thermistor.

In this embodiment, before an image forming apparatus including the fixing device 1 is delivered to a user, temperature correction for the first non-contact thermistor 9 and the second non-contact thermistor 11, which are main thermistors, is performed. The temperature correction is executed in the processing unit 21 on the basis of the flowchart shown in FIG. 4 by invoking a correction mode from the memory 22 of the control unit 20. In the correction, concerning the first non-contact thermistor 9 and the second non-contact thermistor 11, differences between assumed temperatures of the outer circumferential surface of the heat roller 3 in the arrangement positions and the detected temperatures of the first non-contact thermistors 9 and the second non-contact thermistors 11 are set as correction values.

Specifically, the processing unit 21 subjects the heating source 7 to energization control to maintain the detected temperature of the contact thermistor 13 at a predetermined temperature. In the energization control, a difference between the temperature of a temperature detecting region of the heat roller 3 detected by the first non-contact thermistor 9 and the detected temperature of the first non-contact thermistor 9 is a correction value. This processing is explained below according to the flowchart of FIG. 4. In the following explanation, TE represents the detected temperature of the contact thermistor 13, Tc1 represents a target temperature during startup of the correction mode, Tc2 represents a correction mode control temperature, and tc represents control temperature maintenance time.

In Act 1, the processing unit 21 determines whether the detected temperature TE of the contact thermistor 13 is lower than the target temperature Tc1 during the startup of the correction mode. If the detected temperature TE is lower than the target temperature Tc1, the processing unit 21 proceeds to Act 2. If the detected temperature TE exceeds the target temperature Tc1, the processing unit 21 proceeds to Act 5.

In Act 2, the processing unit 21 energizes the heating source 7, heats the heat roller 3, and proceeds to Act 3.

In Act 3, the processing unit 21 determines whether the detected temperature TE of the contact thermistor 13 reaches the correction mode control temperature Tc2. If the detected temperature TE reaches the correction mode control temperature Tc2, the processing unit 21 proceeds to Act 4. If the detected temperature TE does not reach the correction mode control temperature Tc2, the processing unit 21 returns to Act 2 and continues the heating.

In Act 4, the processing unit 21 turns off the energization to the heating source 7 and proceeds to Act 5.

In Act 5, the processing unit 21 starts counting of a timer t and proceeds to Act 6.

In Act 6, the processing unit 21 determines whether the detected temperature TE of the contact thermistor 13 is lower than the correction mode control temperature Tc2. If the detected temperature TE is lower than the correction mode control temperature Tc2, the processing unit 21 proceeds to Act 7. Otherwise, the processing unit 21 proceeds to Act 10.

In Act 7, the processing unit 21 energizes the heating source 7, heats the heat roller 3, and proceeds to Act 8.

In Act 8, the processing unit 21 determines whether the detected temperature TE of the contact thermistor 13 reaches the correction mode control temperature Tc2. If the detected temperature TE reaches the correction mode control temperature Tc2, the processing unit 21 proceeds to Act 9. If the detected temperature TE does not reach the correction mode control temperature Tc2, the processing unit 21 returns to Act 7 and continues the heating.

In Act 9, the processing unit 21 turns off the energization to the heating source 7 and proceeds to Act 10.

In Act 10, the processing unit 21 repeats the operation in Act 6 to Act 8 until the detected temperature TE of the contact thermistor 13 is maintained at the correction mode control temperature Tc2 and a count time of the timer t exceeds the control temperature maintenance time tc. If the detected temperature TE of the contact thermistor 13 is maintained at the correction mode control temperature Tc2 and a count time of the timer t exceeds the control temperature maintenance time tc, the processing unit 21 proceeds to Act 11.

In Act 11, the processing unit 21 reads the detected temperatures of the first non-contact thermistor 9 and the second non-contact thermistor 11 and proceeds to Act 12. The processing unit 21 stores ambient temperature detected by the ambient temperature detection sensor 23 in the memory 22. The detected temperature of the first non-contact thermistor 9 is represented as T31 (first detected temperature). The detected temperature of the second non-contact thermistor 11 is represented as T32 (second detected temperature)

In Act 12, the processing unit 21 calculates correction amounts (T1 and T2) of the first non-contact thermistor 9 and the second non-contact thermistor 11 and ends the processing.

In a state in which the detected temperature of the contact thermistor 13 is maintained at TE, first temperature T21 in a measurement region of the first non-contact thermistor 9 and second temperature T22 in a measurement region of the second non-contact thermistor 11 in the heat roller 3 are known. Therefore, a difference (T21-T31) between the known first temperature 121 and the first detected temperature T31 is a first correction amount (T1). Similarly, a difference (T22-T32) between the known second temperature T22 and the second detected temperature T32 is a second correction amount (T2). The correction amounts are stored in the memory 22.

That is, during feeding of a sheet to the fixing device 1, the heat of the heat roller 3 is taken by the sheet. Therefore, it is necessary to detect the temperature of the nip portion with the non-contact thermistors 9 and 11 and control the temperature to a predetermined fixing temperature. However, the detected temperatures of the non-contact thermistors 9 and 11 are detected lower than actual temperatures because of gaps between the non-contact thermistors 9 and 11 and the heat roller 3. Therefore, the first correction amount (T1) and the second correction amount (T2) are added to the detected temperatures to perform the control.

The first detected temperature T31 and the second detected temperature T32 of the non-contact thermistors 9 and 11 are affected by ambient temperature during the detection as well.

Figure 5:
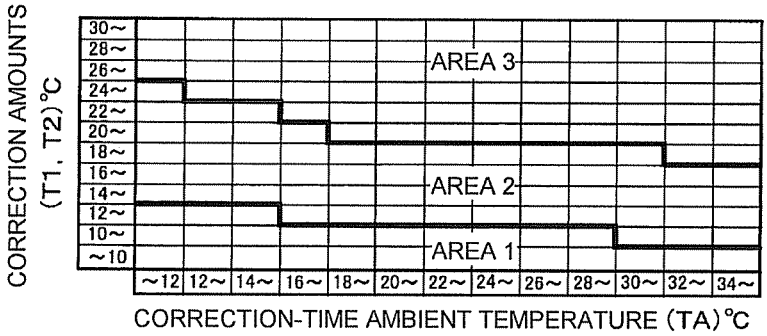
FIG. 5 is a coefficient calculation table for calculating coefficients "a" from a relation between correction amounts and correction-time ambient temperature shown in Table 1.

Therefore, if correction-time ambient temperature (TA) at the time when the first correction amount (T1) and the second correction amount (T2) are calculated and startup-time ambient temperature (TB) during startup of the fixing device detected by the ambient temperature detection sensor 23 when the control is performed by the first non-contact thermistor 9 and the second non-contact thermistor 11 are different, the detected temperatures are corrected according to the values of the first correction amount (T1) and the second correction amount (T2) and a temperature difference between the correction-time ambient temperature TA and the startup-time ambient temperature TB as well. A first ambient correction amount with respect to the first correction amount T1 by the ambient temperature difference is represented as T41 and a second ambient correction amount with respect to the second correction amount T2 by the ambient temperature difference is represented as T42. The first ambient correction amount T41 and the second ambient correction amount T42 are calculated according to Table 1 below and the table of FIG. 5. In Table 1, a1 indicates a coefficient for the first correction amount T1 and a2 indicates a coefficient for the second correction amount T2. As shown in FIG. 5, both the coefficients a1 and a2 are values of "a".

TABLE 1

| | | | |
|---|---|---|---|
| Correction-time ambient temperature (TA) lower than 20° C. | | | |
| TB lower than 20° C. | T41 | T1 + (TA − TB) × a1 | Expression 1 |
| | T42 | T2 + (TA − TB) × a2 | Expression 2 |
| TB equa1 to or higher than 20° C. | T41 | T1 + (TA − 20) × a1 + (20 − TB) × 0.1 | Expression 3 |
| | T42 | T2 + (TA − 20) × a2 + (20 − TB) × 0.1 | Expression 4 |
| Correction-time ambient temperature (TA) equa1 to or higher than 20° C. | | | |
| TB lower than 20° C. | T41 | T1 + (TA − 20) × a1 + (20 − TB) × 0.1 | Expression 5 |
| | T42 | T2 + (TA − 20) × a2 + (20 − TB) × 0.1 | Expression 6 |
| TB equa1 to or higher than 20° C. | T41 | T1 + (TA − TB) × 0.1 | Expression 7 |
| | T42 | T2 + (TA − TB) × 0.1 | Expression 8 |

As shown in Table 1, the first ambient correction amount T41 and the second ambient correction amount T42 are calculated separately for the case in which the correction-time ambient temperature (TA) for calculating the first correction amount Ti and the second correction amount T2 is lower than 20° C. and for the case in which the correction-time ambient temperature (TA) is equal to or higher than 20° C. (Expressions 1 to 4) Further, if the correction-time ambient temperature is lower than 20° C., the first ambient correction amount T41 and the second ambient correction amount T42 are calculated separately for the case in which the ambient temperature TB during startup (e.g., during power-on or during switching from a standby state to a fixable state) is lower than 20° C. and for the case in which the ambient temperature during startup is equal to or higher than 20° C. Further, even if the correction-time ambient temperature (TA) is equal to or higher than 20° C., the first ambient correction amount T41 and the second ambient correction amount T42 are calculated separately for the case in which the startup-time ambient temperature TB is lower than 20° C. and for the case in which the startup-time ambient temperature TB is equal to or higher than 20° C.

In Expressions 1 and 2 shown in Table 1, values obtained by multiplying a difference between the correction-time ambient temperature (TA) and the startup-time ambient temperature (TB) with predetermined coefficients (a1 and a2) are further added to the correction amounts (T1 and T2) to calculate the first ambient correction amount T41 and the second ambient correction amount T42. In Expressions 3 and 4, sums of values obtained by multiplying, with the coefficients (a1 and a2), a value obtained by subtracting a threshold temperature 20° C. from the correction-time ambient temperature (TA) and a value obtained by multiplying, with a coefficient 0.1, a value obtained by subtracting the startup-time ambient temperature (TB) from the threshold temperature 20° C. are further added to the correction amounts (T1 and T2) to calculate the first ambient correction amount T41 and the second ambient correction amount T42.

Expressions 5 and 6 are the same as Expressions 3 and 4. In Expressions 7 and 8, values obtained by multiplying the difference between the correction-time ambient temperature (TA) and the startup-time ambient temperature (TB) with the coefficient 0.1 are further added to the correction amounts (T1 and T2) to calculate the first ambient correction amount T41 and the second ambient correction amount T42.

FIG. 5 is a table for calculating coefficients "a" (a1 and a2) from a relation between the correction amounts (the first correction amount T1 and the second correction amount T2) ° C. and the correction-time ambient temperature (TA) ° C. The table is divided into three areas (an area 1, an area 2, and an area 3). A value of the coefficient "a" in the range of the area 1 is set to 0.3, a value of the coefficient "a" in the range of the area 2 is set to 0.4, and a value of the coefficient "a" in the range of the area 3 is set to 0.5.

In FIG. 5, if a value of the first correction amount T1 is, for example, 17° C. and the correction-time ambient temperature (TA) is 14° C., the coefficient "a" belongs to the range of the area 2 and is 0.4.

If the startup-time ambient temperature (TB) is equal to or higher than 20° C., as shown in Table 1, the first ambient correction amount (T41) is calculated by Expression 3 and 0.4 is used as the coefficient a1. The second ambient correction amount (T42) is calculated by Expression 4 and 0.4 is used as the coefficient a2.

On the other hand, if normal control is applied to the fixing device 3, since the non-contact thermistors 9 and 11 have poor responsiveness, the contact thermistor 13 is used for temperature detection immediately after startup. A target temperature is changed as shown in Table 2 below according to a temperature state of the fixing device 1 during the startup. After the temperature of the fixing device 3 reaches the target temperature, the control is switched to the non-contact thermistors. The target temperature is desirably set lower than the fixing temperature by 10 to 30° C. and, preferably, 20 to 30° C.

By adopting such a configuration, it is possible to accurately control the fixing device.

TABLE 2

| Fixing device state | Target temperature |
|---|---|
| Fixing device temperature lower than 20 degrees | 110 degrees |
| Fixing device temperature equal to or higher than 20 degrees and lower than 40 degrees | 110 degrees |
| Fixing device temperature equal to or higher than 40 degrees and lower than 60 degrees | 115 degrees |
| Fixing device temperature equal to or higher than 60 degrees and lower than 80 degrees | 120 degrees |
| Fixing device temperature equal to or higher than 80 degrees and lower than 100 degrees | 120 degrees |
| Fixing device temperature equal to or higher than 100 degrees | 120 degrees |

Temperature control by the contact thermistor

Temperature Control by the Contact Thermistor

In Table 2, if the temperature of the fixing device 1 is equal to or higher than 40° C. and lower than 60° C., the temperature control is performed using the contact thermistor 13 up to 115° C. If the temperature exceeds 115° C., the first non-contact thermistor 9 and the second non-contact thermistor 11, which are the main thermistors, are used according to the width of a sheet to perform energization control for the heating source 7 to set the temperature of the outer circumferential surface of the heat roller 3 to a predetermined temperature.

In the embodiment explained above, as an example of the heating device, the fixing device that fixes a toner transferred onto a sheet by heating and pressurizing the toner is explained. However, the heating device may be applied to a decoloring device that heats a decolorable toner to a decoloring temperature and decolors the toner. Further, the heating device may be used both as the fixing device and the decoloring device.

Further, in the embodiment, as an example of the heating member, the heat roller is explained. However, the heating member may be a heating belt. The heating source may be an IH system in which an induction current generating coil is used.

According to the embodiment, it is possible to perform highly accurate temperature control using the first non-contact thermistor 9 and the second non-contact thermistor 11, which are the main thermistors. It is possible to perform the highly accurate temperature control irrespective of the ambient temperature during startup.

While certain embodiments have been described, these embodiments have been presented by way of example only, and are not intended to limit the scope of the inventions. Indeed, the novel embodiments described herein may be embodied in a variety of other forms; furthermore, various omissions, substitutions, and changes in the form of the embodiments described herein may be made without departing from the spirit of the inventions. The accompanying claims and their equivalents are intended to cover such forms or modifications as would fall within the scope and spirit of the inventions.

What is claimed is:

1. A heating device that heats a toner image on a sheet fed to a nip portion between a heating member and a pressurizing member, the heating device comprising:

a heating source configured to heat the heating member;

a non-contact thermistor arranged while having a gap between the non-contact thermistor and the heating member and configured to detect temperature of the heating member;

a contact thermistor configured to come into contact with the heating member and detect temperature of the heating member; and an ambient-temperature detecting unit configured to detect ambient temperature of the heating device, a detected-temperature correcting unit configured to calculate, in advance, a correction amount for the detected temperature of the non-contact thermistor;

an ambient-temperature correcting unit configured to further correct, on the basis of the ambient temperature detected by the ambient-temperature detecting unit, the correction amount calculated by the detected-temperature correcting unit; and a control unit configured to control the heating source on the basis of the detected temperature of the non-contact thermistor and the detected temperature of the contact thermistor and control the heating member to a predetermined temperature.

2. The heating device according to claim 1, wherein the ambient-temperature correcting unit calculates an ambient correction amount for further correcting the correction amount on the basis of correction-time ambient temperature detected by the ambient-temperature detecting unit when the correction amount is calculated and startup-time ambient temperature detected by the ambient-temperature detecting unit during startup of the heating device.

3. The heating device according to claims 1 or 2, wherein the control unit changes the target temperature according to a temperature state of the heating member.

4. The heating device according to claim 3, wherein the control unit divides a temperature state of the heating member into a plurality of temperature ranges and sets a target temperature for each of the temperature ranges.

* * * * *